United States Patent [19]

Ostermann

[11] 4,299,335

[45] Nov. 10, 1981

[54] NEWSPAPER VENDOR

[75] Inventor: Peter Ostermann, Sunnyvale, Calif.

[73] Assignee: Hickey-Mitchell Company, St. Louis, Mo.

[21] Appl. No.: 24,546

[22] Filed: Mar. 28, 1979

[51] Int. Cl.[3] ..... G07F 11/14

[52] U.S. Cl. ..... 221/241; 221/279

[58] Field of Search ..... 221/155, 227-232, 221/241, 244, 253, 279, 280; 220/93; 312/71; 194/2

[56] References Cited

U.S. PATENT DOCUMENTS

| | | | |
|---|---|---|---|
| D. 231,015 | 3/1974 | Chalabian | D52/3 R |
| 1,622,262 | 3/1927 | Kindrat et al. | 221/232 X |
| 2,984,326 | 5/1961 | Westphal | 194/59 |
| 3,125,247 | 3/1964 | Knickerbocker | 221/279 |
| 3,174,608 | 3/1965 | Knickerbocker | 194/54 |
| 3,831,809 | 8/1974 | Knickerbocker | 221/227 |
| 3,957,175 | 5/1976 | Gordon | 221/215 |
| 4,067,474 | 1/1978 | Chalabian | 221/241 X |
| 4,139,120 | 2/1979 | Moore | 221/244 |
| 4,140,242 | 2/1979 | Muller et al. | 221/241 X |

*Primary Examiner*—F. J. Bartuska
*Attorney, Agent, or Firm*—Kalish & Gilster

[57] ABSTRACT

A newspaper vendor provides vending of a single newspaper per vend cycle. The vendor has an enclosure holding a stack of newspapers and an elevator within the enclosure for automatically continuously lifting the stack to present a single uppermost newspaper upon the stack at a vend position. A coin mechanism is interengaged by a vend control door. The door is released by the coin mechanism to permit manual access to the uppermost newspaper for withdrawal through a vend throat which is adjustable in dimension to correspond to an average thickness of newspapers in the vendor. A blocking mechanism is responsive to withdrawal of the uppermost newspaper to block withdrawal of a subsequent newspaper through the throat during the vend cycle. A braking mechanism and pivot arrangement associated with the elevator automatically cause the uppermost newspaper to be in alignment with the vend throat regardless of skewing of the stack resulting from non-uniform thicknesses of individual newspapers.

5 Claims, 15 Drawing Figures

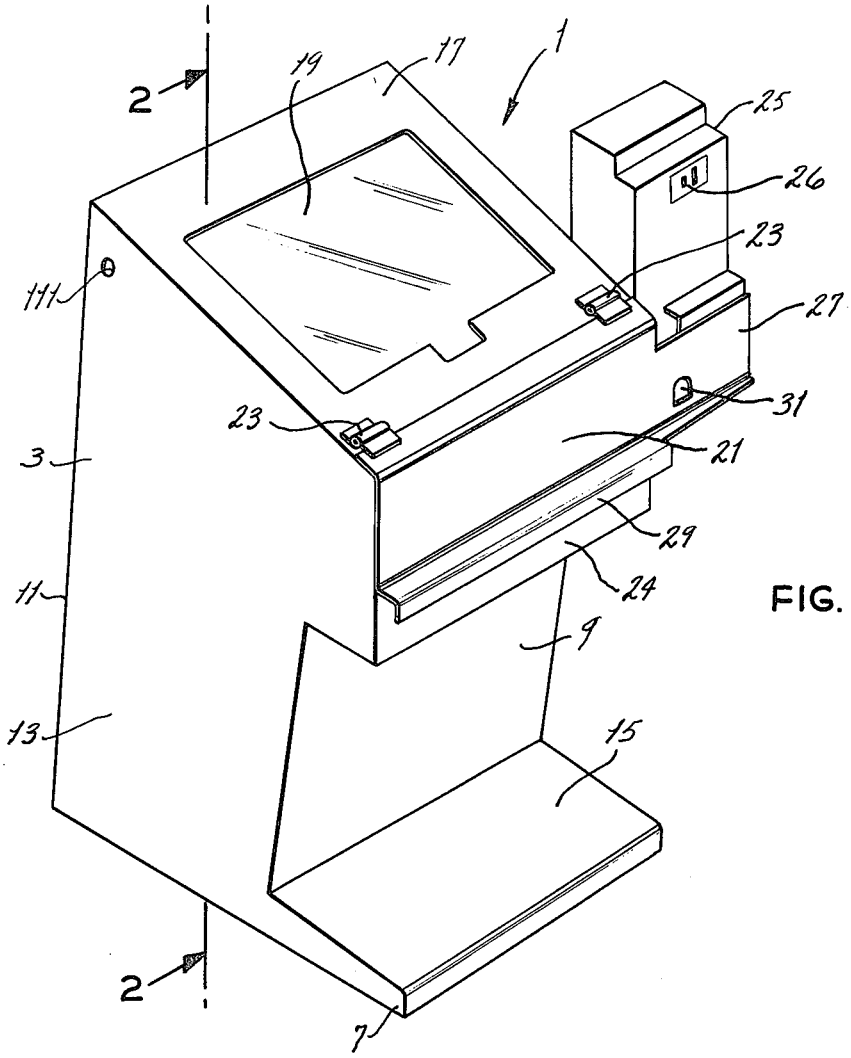
FIG. 1
FIG. 15
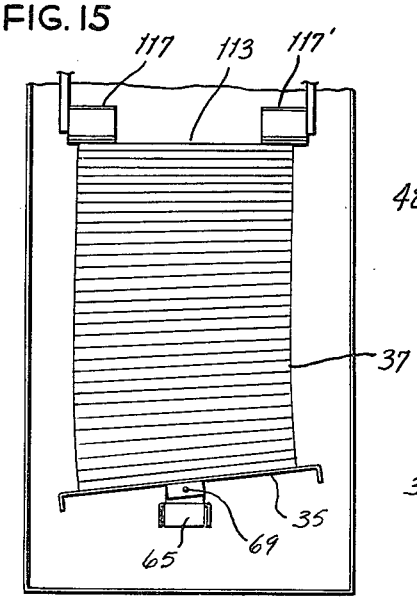
FIG. 14
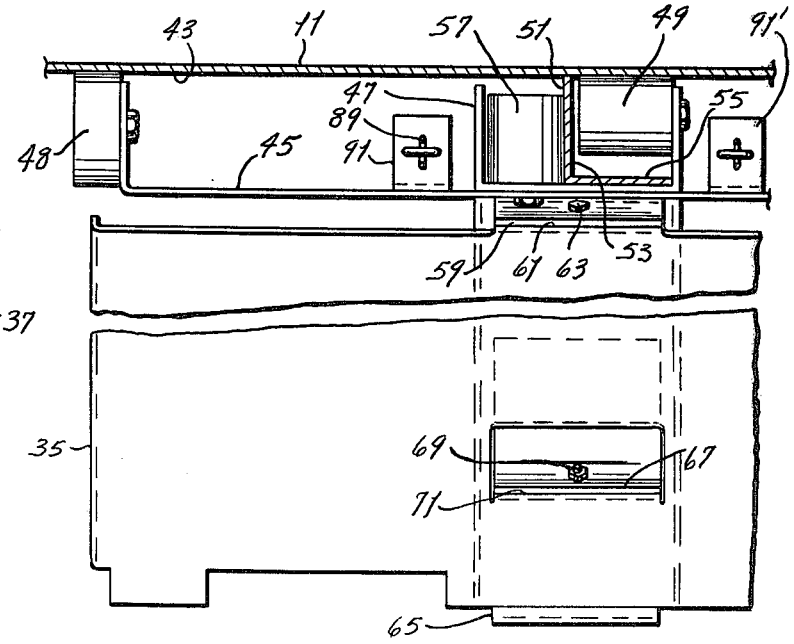

NEWSPAPER VENDOR

BACKGROUND AND SUMMARY OF THE INVENTION

The present invention relates to a dispensing apparatus and, more particularly, to an improved vendor for permitting vending of a single newspaper or the like per vend cycle.

It is well known to provide newspaper vending machines which permit access to a stack of newspapers upon feeding coins of sufficient value to a coin operated mechanism. Once access is gained, the purchaser may withdraw a newspaper but one must rely only upon the honor and integrity of the purchaser as assurance that no more than a single copy will be taken. Nothing physically prevents a purchaser from withdrawing extra copies of newspapers for which the purchaser has not paid and to which he is not entitled.

To overcome this difficulty, there has heretofore been known a first general type of prior art newspaper vendor which permits withdrawal of a single newspaper. Various mechanisms for this purpose have been suggested, including movement, in response to vending of a first newspaper of a blocking member into the path of subsequent newspapers for preventing withdrawal until a subsequent vending operation is made possible by insertion of the proper coin in a control mechanism.

A second general type of prior art utilizes a different principle for permitting only a single newspaper to be delivered for each operation of a coin mechanism. In vendors of this type, some sort of paper delivery mechanism is utilized to retrieve a single newspaper copy, e.g., from a stack of newspapers, and to dispense this copy to the customer. For example, a slide may be used which has a plurality of pointed members which contact the bottom newspaper whereby only it is pulled from the stack upon forward movement of the slide, when released by the coin mechanism. One difficulty inherent in this approach is that the stack is limited in size since the weight of too many newspapers above the lowermost copy which is to be vended may cause binding between copies with consequent tearing or ripping of newspapers during vending, or may create other difficulties in operation.

As will be recognized, newspapers conventionally are folded along the side and in the middle which provide increased thicknesses of the individual newspapers at the side and middle fold. Therefore, when stacked, these non-uniform thicknesses are multiplied in effect so that the newspaper stack is, in effect, skewed whereby the uppermost newspaper on the stack are slanted or at a considerable angle to the surface on which the stack is supported.

Although the first type of dispensing apparatus can hold a relatively large stack of newspapers from which the uppermost copy is to be vended, a serious difficulty arises by virtue of this skewing of the stack. This skewing can cause the uppermost newspaper not to be properly aligned for being vended. Therefore, this type of apparatus may jam or fail to properly operate or to present the newspaper in a position in which it can successively be vended. Or, if it permits the newspaper to be vended, it may cause tearing of the newspaper during vending.

Prior art newspaper vendors permitting vending of a single newspaper have typically been difficult to load.

Accordingly, an object of the present invention is the provision of an improved vendor for permitting vending of a single newspaper or the like, such as another type of publication, per vend cycle.

A further object of the invention is the provision of such a vendor which provides trouble-free successive vending of newspapers in response to proper insertion of coin regardless of variations in the thickness of paper resulting from folds therein.

Another object of the invention is the provision of such a vendor which presents a newspaper to be properly vended regardless of the overall average thickness of individual newspapers, whereby different editions or newspapers having vastly different numbers of pages all may be properly vended.

A further object of the invention is the provision of such a vendor which does not damage, tear, rip or perforate papers during vending.

Another object of the invention is the provision of such a vendor which can contain a large supply of newspapers.

Another object of the invention is the provision of such a vendor which encloses such a large supply of newspapers entirely to keep the elements such as rain, snow, sleet or ice from damaging newspapers contained within the vendor.

Still another object of the invention is the provision of such a vendor which displays papers to be vended in an easily viewed and attractive manner.

A further object of the invention is the provision of such a vendor which is easily assembled and constructed of inexpensive materials, conducing to economical massproduction types of manufacture, and which has a rugged, long-lasting, relatively damage-proof construction.

A further object of the invention is the provision of such a vendor which is extremely simple to load with newspapers and which permits bulk loading of newspapers therein, even without requiring prior removal of binding wire or strapping which is conventionally applied by publishers to stacks of newspapers for distribution thereof.

A related object of the invention is the provision of such a vendor which does not require one to lean over or assume an awkward position for either loading of the newspapers therein by service personnel or for withdrawal of newspapers from the customer.

A further object of the invention is the provision of such a vendor which does not require stack alteration or reconfiguration, and which does not require alternation of copies, or other preparation of newspapers prior to their being loaded into the vendor in bulk as a stack.

Among still further objects of the invention may be noted the provision of such a vendor which is simply and easily assembled and maintained, which is easily adjusted in use for different thicknesses of newspapers, and which is reliable and fool-proof over long periods of operation.

Other objects will be in part apparent and in part pointed out hereinbelow.

BRIEF DESCRIPTION OF THE DRAWINGS

FIG. 1 is a perspective view of a newspaper vendor constructed in accordance with and embodying the present invention.

FIG. 14 is a horizontal cross-section of an elevator mechanism taken generally along line 14—14 of FIG. 3.

FIG. 15 is a simplified vertical cross-section taken through the center of the vendor for illustrating the positioning of a stack of newspapers on said elevator.

Corresponding reference characters indicate corresponding parts throughout the several views of the drawings.

DESCRIPTION OF THE PREFERRED EMBODIMENT

Figure 2:
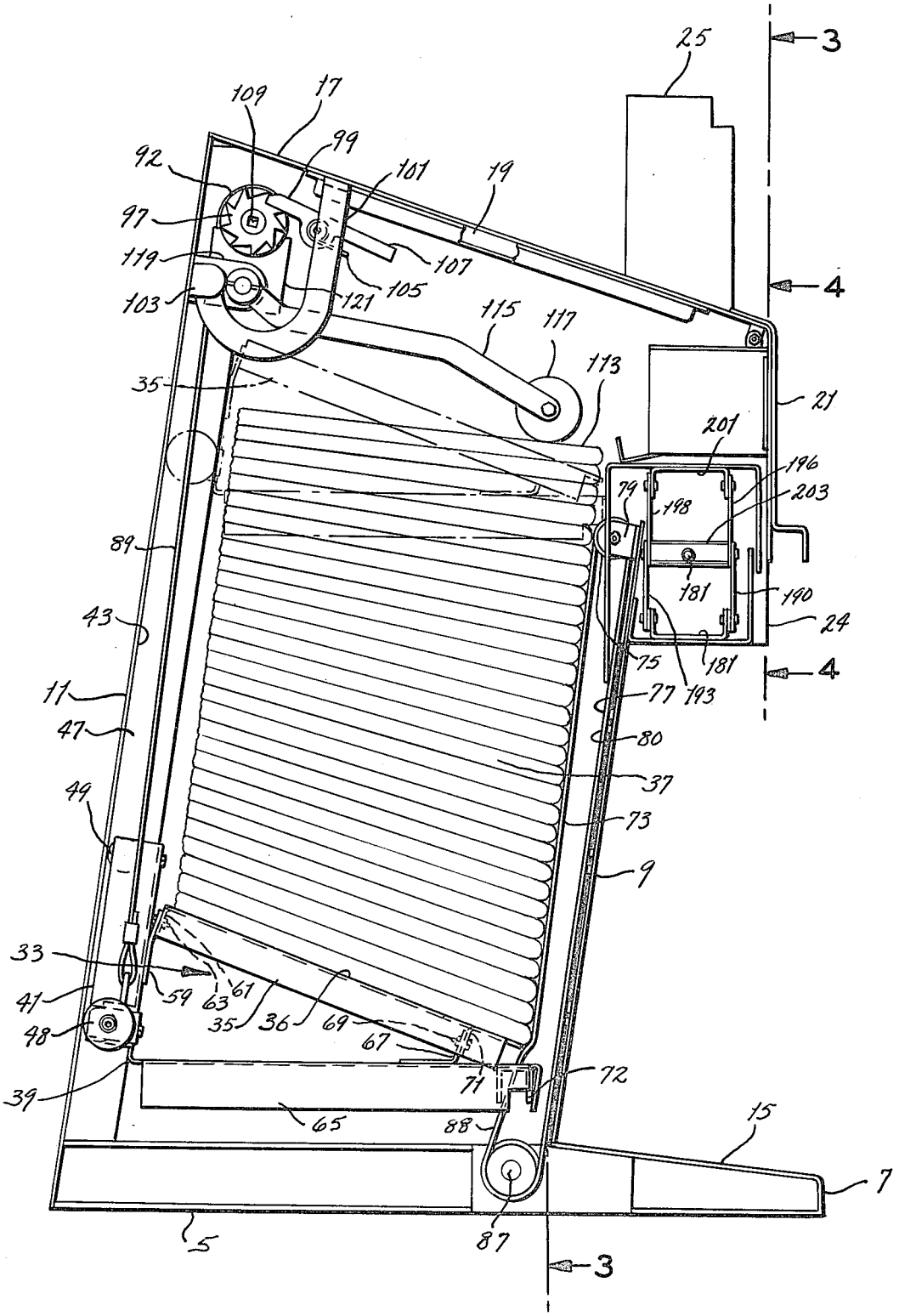
FIG. 2 is a vertical cross-section taken generally along line 2—2 of FIG. 1.

Referring now to the drawings, there is illustrated generally at 1 a newspaper vendor of the present invention. The vendor has a cabinet 3 constituting an enclosure for a large stacked supply of newspapers. Cabinet 3 has a base 5 including a forwardly front portion or foot 7 which provides additional support at the front of the vendor to prevent it from being tipped over.

More specifically, cabinet 3 may be formed of sheet steel or other strong, resilient synthetic resin material and is configured to slope somewhat forwardly from base 5 so that the front wall 9 and rear wall 11 are each angled with respect to the ground or other surface upon which the vendor rests (see FIG. 2). The cabinet side walls at 13,13' are upright, each being perpendicular to the supporting surface. Foot 7 has a sloped upper surface 15 for pleasing appearance and to prevent moisture or dust, etc. from accumulating.

The top surface 17 of the vendor is sloped forwardly to an even greater degree and is hinged at the rear to be capable of being swung open under circumstances later described for permitting newspapers to be loaded into the vendor.

Positioned centrally of the top surface is a transparent panel 19 of synthetic resin material for permitting the customer to see a copy of a newspaper to be vended and thus providing the capability of observing the headlines and the date, etc., as well as to assure the customer that at least one newspaper remains to be vended.

For vending purposes, an access cover is provided at the front of the vendor, being hinged as indicated at 23 for being swung open by the customer to receive a newspaper during a vend cycle. The access cover extends downwardly over an overhang or forwardly extending portion 24.

Secured to the right side of the vendor is a coin mechanism 25 conventional, commercially available type. Since such devices are well-known, in the interest of brevity, there is no need to provide a description of the device except to note that it is preferably affixed hingedly to the right side of the vendor and receives coins through slots 26. Covering the lower part of coin mechanism 25 is an extension 27 of access cover 21. Said extension has suitable means, such as a bail or stud, etc., which is appropriately engageable by coin mechanism 25 for locking cover 21 in the position shown but for releasing it to be swung open when coins of sufficient value and combination are fed into the coin slots 26. Then, upon having deposited the coins, the customer may open access cover 21 to obtain a single copy of a newspaper. For this purpose, cover 21 is provided with a lip 29 extending the width of its lower edge for being grasped by the customer. An aperture 31 in cover extension 27 permits retrieving any coins which may be returned by mechanism 25.

Referring to FIG. 2, provided within the vendor is an elevator indicated generally at reference numeral 33 having a platform 35 for carrying a stack 37 of newspapers and for continuously lifting said stack for presentation of newspapers for being vended successively. As is apparent, such stack 37 is of considerable height, being constituted by a much greater number of newspapers than typically has heretofore been capable of being contained within prior art vendors.

Elevator platform 35 is supported at its front and rear by separate cable-and-spring mechanisms described hereinbelow but may be noted as being constituted by a single sheet of material such as sheet steel providing a surface 36 which is sloped toward the front of the vendor for causing forward leaning of the newspaper stack and for other purposes which will shortly become apparent. Platform 35 has a width, i.e., as measured across the vendor, slightly greater than the width of a single copy of a conventionally sized newspaper and has a depth, i.e., a front-to-back dimension, slightly greater than the corresponding dimension of a folded copy of a newspaper.

Platform 35 is mounted upon a carriage assembly 39 having a tram 41 adapted for movement upwardly along a track on the inner surface 43 of enclosure back wall 11. The tram comprises a bracket extending horizontally proximate the rear of wall 11 and carrying at its opposite ends rollers as indicated in FIG. 14 at reference numeral 48 for rolling engagement with inner wall surface 43. Located centrally of the bracket and secured thereto, as by spot welding, is a channel member 47 opening toward surface 43. Carried by channel member 47 is a roller 49 which is adapted also to bear against surface 43, said roller being located upwardly of the side rollers 68 to provide a stable three point rolling engagement of the tram with surface 43. Carried on back wall 11 and extending outwardly from inner surface 43 thereof is an Z-shaped length of stock constituting a track or guide member 51 for the tram. Member 51 extends upwardly from base 5 along the back wall to a point above the uppermost reach of the intended travel of elevator platform 35.

Referring to FIG. 14, it will be seen that guide 51 has an outwardly oriented web 53 and a laterally directed web 55, the latter being engageable by roller 49 to hold the tram generally against back wall 11. Also carried by channel member 47 is a roller 57 with its axis of rotation at right angles to that of rollers 48,49 for providing rolling engagement against web 53 of the guide, thereby to maintain lateral alignment of the tram within cabinet 3. There are two such rollers 57, being at respective opposite ends of channel member 47.

For the purpose of supporting platform 35, channel member 47 is provided with a tab 59 located centrally thereof and extending slightly outwardly into the space within the vendor enclosure. Platform 35 is provided with a corresponding tab or flange 61 which is bolted as indicated at 63 to tab 59 in a manner permitting pivoting about the bolt for lateral tipping of the platform for purposes presently appearing. Extending forwardly from the lower portion of channel member 47 is a flanged bracket 65 having also a tab 67 carried proximate its outward end and bolted as indicated at 69 to a tab 71 constituted by a portion of platform 35 which has been stamped therefrom and bent downwardly. Again, such bolt securement 69 is such as to permit pivoting movement of platform 35 with respect to bracket 65. In this manner, platform 35 is supported by tram 41 but is laterally tippable on an axis extending through bolts 63,69.

For the purpose of lifting platform 35 by means of carriage assembly 39, there is also provided a bracket 72 carried at the outermost extremity of bracket 65. Bracket 72 is constituted by a length of U-shaped channel section, being secured centrally to bracket 65. Secured to the outer extremities of bracket 72 are respective front cables 73,73' which extend upwardly therefrom over respective pulleys 75,75' secured to the inner surface 77 of the cabinet front wall 9, as by brackets 79,79' welded thereto. The cables then pass downwardly from the pulleys as reaches designated 80,80' and are wrapped around and appropriately secured at their ends to a tubular member 81 of cylindrical form housing a spiral torsion coil spring 83.

Spring housing 81 is journalled at opposite ends between frame members 85,85' for rotation about an axis 87 (see FIG. 2), it being understood that torsion spring 83 is secured at one end to housing 81 and at its opposite end to one of the frame members of the base and is appropriately tensioned by winding for resiliently biasing the spring housing for rotation in a direction for winding the cables to lift the elevator carriage assembly. There also are reaches 88,88' of the cables which extend downwardly from bracket 39 and are wrapped in several turns about spring housing 81. These unwind as reaches 80,80' wind.

Similarly, at the rear of platform 35 are a pair of lifting cables 89,89' secured at their lower ends to lifting blocks 91,91' of bracket 45. These cables are wrapped around an upper cylindrical spring housing 92. Cables 89,89' are each wrapped around spring housing 92 and have their ends appropriately secured thereto. Housing 92 is journalled at opposite ends between frame members 93,93' at the sides of cabinet 3 proximate the inner surface 43 of rear wall 11. Like the lower spring housing, upper spring housing 92 contains a spiral torsion coil spring 95, one end of which is suitably affixed to the housing and the other to one of the brackets 93,93' whereby, when appropriately tensioned, the spring will cause cables 89 to be tensioned for lifting the rear of platform 35 by means of carriage assembly 39.

As has been alluded to, newspapers conventionally are folded along the side and then again in the middle whereby each individual newspaper has a non-uniform thickness, being somewhat thicker in the regions of the side and middle fold. Ordinarily such non-uniform thickness is not very noticeable and is not a matter of consequence when dealing with but a few newspapers. But when large numbers of newspapers are stacked, such non-uniform thicknesses are effectively multiplied to cause skewing of the stack. I.e., either the stack will lean away from the folds, or if kept from leaning will be slanted at the top. In fact, with a stack of 50 or 100 newspapers, for example, the surface of the uppermost newspaper on the stack will be slanted at a very considerable angle to the surface on which the stack is supported. The effect of such skewing on a stack is illustrated by stack 37 wherein the uppermost surface of the newspaper on a stack is seen to be at a considerable angle to platform 35. Such skewing also causes lateral tipping of elevator platform 35 (as shown in FIG. 15) about which more is stated later.

Referring to FIG. 2, a ratchet 97 is provided at one end of upper spring housing 92 and is engaged by a spring loaded pawl 99 pivotally attached to the left side wall by a bracket (not shown). An arm 101 is seen to be secured at one end to cover 19 and pivotally is shown secured at the other end as indicated at 103 to the back wall 11 whereby cover 19 is effectively hinged for permitting it to be opened for loading of newspapers. A spring 105 biases pawl 99 into engagement with ratchet 97, the pawl having an extension 107 which can be pressed downward by an authorized person having access to the interior of the apparatus for selective disengagement of the pawl to release the tension of spring 95 which otherwise is maintained in its wound, tensioned condition.

One end of housing 92 is provided, for this purpose, with a flatted extension, socket or other tool fitting 109 which is suitably engageable by a tightening tool, such as a keyed crank or wrench applied through an aperture 111 in a side wall of the device. Fitting 109 may be at the opposite side of the device, if desired, for direct rotation of housing 92 rather than spring 95. But, in either case, its rotation permits spring 95 to be tensioned, the spring tension provided by this cable arrangement causing elevator platform 35 to be biased resiliently upward for presenting newspapers continuously for being vended. Thus, the stack 37 of newspapers is lifted so that the uppermost newspaper 113 of the stack is in position for being vended, as illustrated.

To limit upward movement of the elevator, a braking mechanism is associated with spring housing 92 and comprises pairs of brake arms 115,115' having respective rollers 117,117' pivotally secured at their proximal ends by respective pivot assemblies 119,119'. Each such assembly is substantially identical, one being the mirror image of the other, the assemblies being symmetrically placed, as evidenced in FIG. 3. Said pivot assemblies have associated with them respective braking elements 121,121' which are adapted to engage the periphery of spring housing 92 upon movement of the respective brake arm 115 to the position illustrated in FIG. 2.

Figure 10:
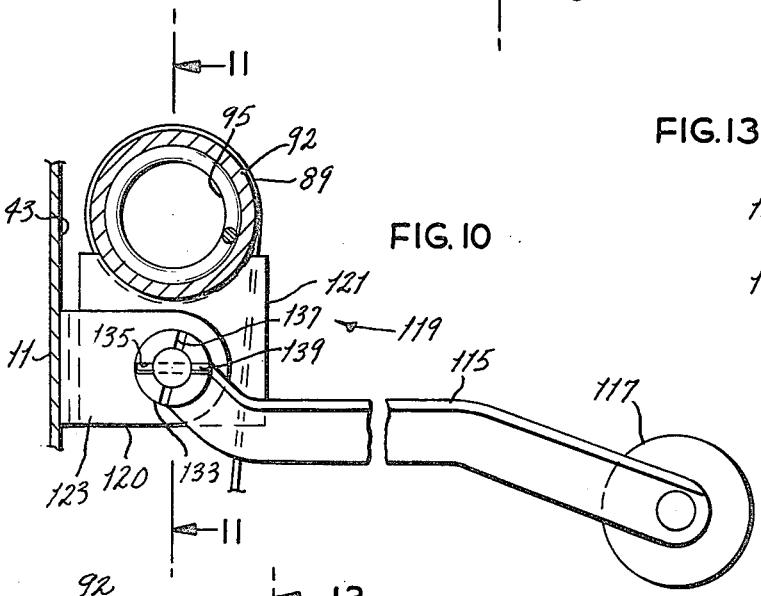
FIG. 10 is a vertical cross-section taken generally along line 10—10 of FIG. 3 illustrating a certain braking mechanism of the vendor.
Figure 11:
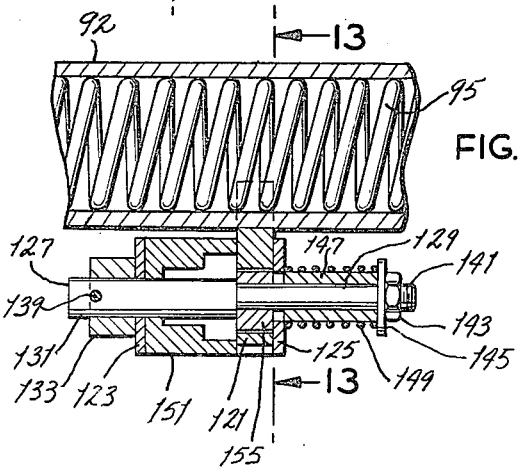
FIG. 11 is a vertical cross-section taken generally along line 11—11 of FIG. 10.
Figure 12:
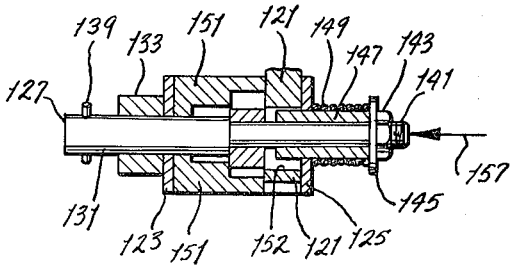
FIG. 12 is a vertical cross-section similar to FIG. 11 illustrating certain aspects of the braking mechanism of FIG. 10.

Because of the identity of operation of each assemblies 119,119', it sufficies to explain only one. Referring additionally to FIGS. 10–12, it is seen that each such assembly comprises a U-shaped bracket 120 secured to the inner surface 43 of cabinet rear wall 11, as by being welded thereto. The bracket has outwardly extending flanges 123,125 which are apertured for journalling therein of a pivot pin or shaft 127 having a reduced diameter portion 129 and larger diameter portion 131. Upon the latter is rotatably fitted a collar 133 constituting the proximal end of the respective brake arm 115. Said collar is provided in its outermost surface with pairs of radial slots 135,137 for receiving a pin 139 which extends through the end of pin portion 131. The reduced diameter portion 129 of the pivot pin is threaded at its outer extremity as indicated at 141, having a nut 143 thereon for securing a thrust washer 145 and a sleeve 147 extending coaxially around reduced pin portion 129. Coaxially surrounding sleeve 147 is a spiral compression spring 149 which bears at one end against flange 125 and at the other end against thrust washer 145 for biasing shaft 127 in the direction away from collar 133 for seating pin 139 in the radial collar slots.

Figure 13:
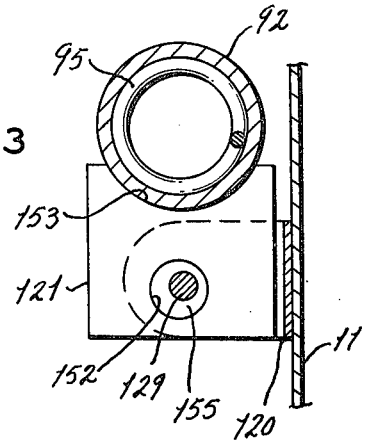
FIG. 13 is a vertical cross-section taken generally along line 13—13 of FIG. 11.

Fitted between bracket extensions or flanges 123,125 is a spacer 151 adapted to bear against braking member 121. The latter is seen in FIG. 13 to constitute a block having an aperture 152 therein located eccentrically with respect to the axis of rotation of pin portion 129 and having a U-shaped recess 153 at the upper end thereof for conforming to the periphery of spring housing 92. Fitted within aperture 152 is a cam or eccentric 155 secured to shaft portion 129 whereby, upon rotation of shaft 127 by movement of brake arm 115 when contacted by the upper surface of newspaper stack 37, eccentric 155 causes upward movement of brake block 129 for impeding rotation of spring housing 92. This limits upward movement of the elevator. As will be seen, pin 139 when seated in radial slots 135 of collar 133 permits movement of arm 115 to cause rotation of shaft 127.

For the purpose of permitting the brake arms 115,115' to be raised for loading the stack 37 of newspapers in the vendor, shaft 127 is adapted to be shifted laterally as depicted in FIG. 12 by force applied by finger pressure in the direction indicated by an arrow 157. When so moved, eccentric 155 is shifted with respect to aperture 151 of the brake block but, more importantly, pin 139 is no longer seated in the radial groove 135 of the collar. Therefore, brake arm 115 is free to be lifted and hence rotated upwardly for unencumbered access to the interior of the vendor. As will be apparent, both of arms 115,115' are raised in this manner for loading newspapers into the vendor.

Figure 3:
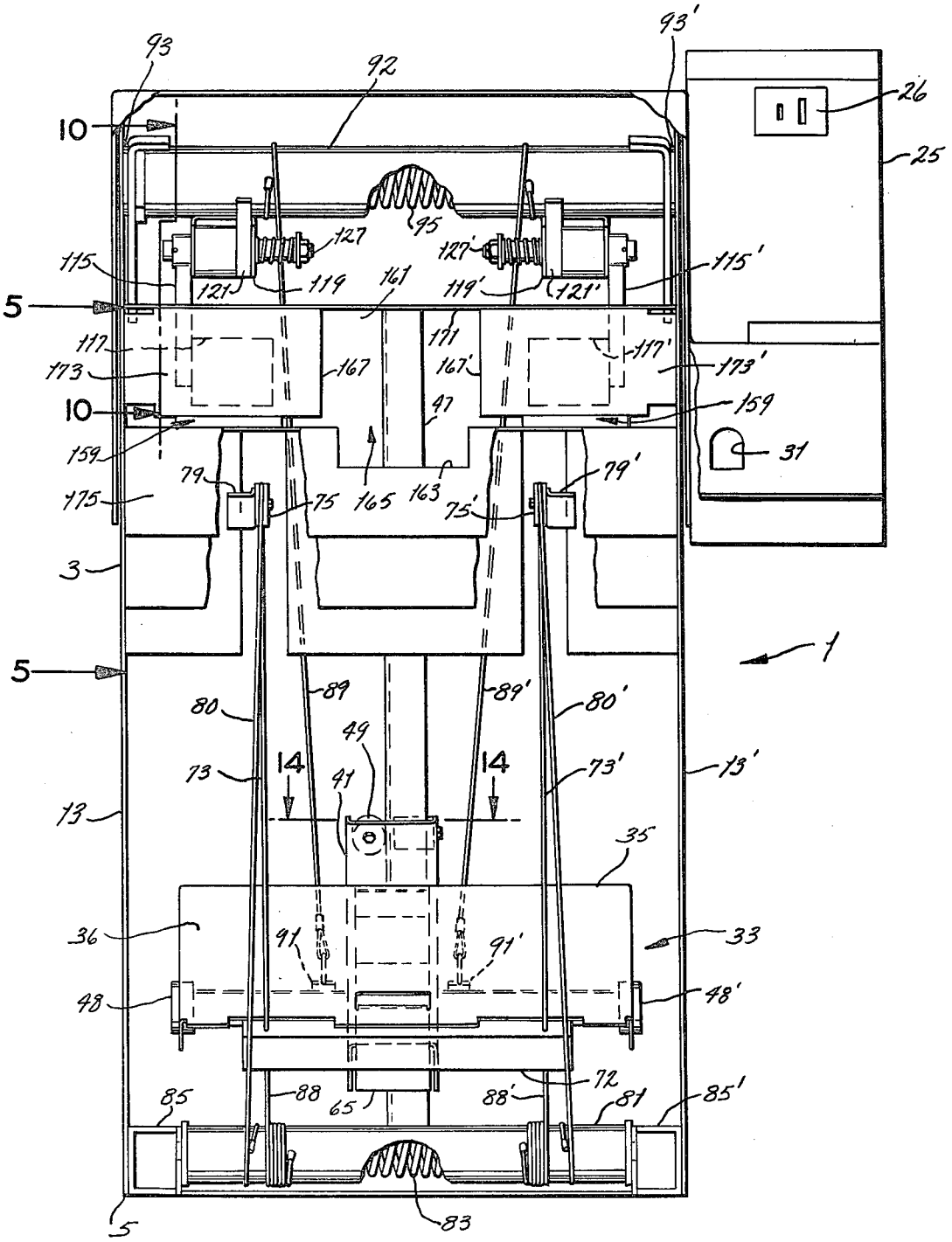
FIG. 3 is a vertical cross-section developed generally along line 3—3 of FIG. 2.
Figure 4:
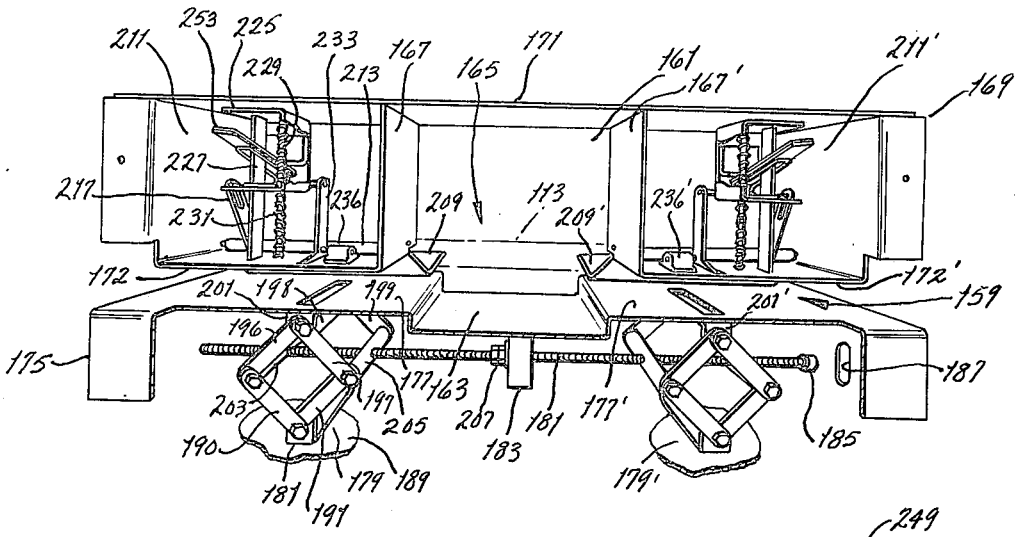
FIG. 4 is a perspective view of latch and adjustable throat mechanisms of the vendor as viewed from the front separately from the vendor.

Assuming the vendor to be provided with newspapers and the top closed, reference is made to FIGS. 3 and 4 for the purpose of explaining vending of newspapers. The uppermost newspaper on stack 37 is adapted to be provided through a throat designated generally at 159 after cover 21 is released by coin mechanism 25 and opened by hand, being then in a position represented in FIGS. 6–8. In this position, cover 21 renders accessible enlarged upper and lower portions 161,163 of throat 159 wherein the customer may insert a hand for manually withdrawing the uppermost newspaper 113 on stack 37, the uppermost copy being shown in phantom in FIG. 4 wherein it may be appreciated that it is accessible for simply being grasped by the customer. Throat enlargements or extensions 161,163 together represent, therefore, a mouth 165 rendering the uppermost newspaper 113 accessible to the customer.

Throat 159 is dimensionally adjustable in vertical spacing to correspond with the average thickness of each of the newspapers which are contained in stack 37. For this purpose, extending across the lower portion of throat portion 159 and defining throat extension 163 is a carriage 175 which is vertically positionable. Said carriage, which is shown broken away in FIG. 4, is defined by panels of sheet metal or the like to define surfaces 177,177' which are respectively spaced below the corresponding lower surfaces or plates 172,172' of the latch housing. Then surfaces are stepped downward in the region of mouth 165 to provide throat lower extension 163. The spacing between the corresponding plates 172,177 and 172',177' is variable to alter the dimensions of the throat by movement of carriage 175 up or down.

It should be here noted that on either side of mouth 165 and defining throat upper extension 161 are a pair of oppositely disposed housings 167,167' each containing a latch mechanism to be described shortly but which housings are fixedly positioned within cabinet 3 as a unit 169 secured to cover 17 whereby it will be lifted out of the way with the cover when it is opened for loading of newspapers. When the cover is closed (see FIG. 4) unit 169 extends between the side walls 13,13', being of a welded steel structure having a plurality of metal panels including one such panel 171 which defines the upper extent of mouth 165. Such panels also define lower surfaces or plates 172,172' of the latch housings. Although housings 167,167' are closed in the vendor as assembled for use, the housings are depicted as being open in FIG. 4 merely for the purposes of illustration, it being understood that cover plates, as illustrated at 173,173' in FIG. 3 are normally present.

The vendor is provided with dual four-bar linkages 179,179' for lifting the carriage up and down. Since these mechanisms are identical, it suffices to describe only one, but it is noted that both are operated simultaneously by a threaded rod or jack screw 181 which extends through a vertically slotted bracket 183 secured to throat lower surface 165. The rod 181 terminates in either a socket or suitable flatted end or other fitting 185 which is accessible by a tool or crank inserted through an aperture 187 when coin mechanism 25 is moved out of the way by an authorized person.

Figure 5:
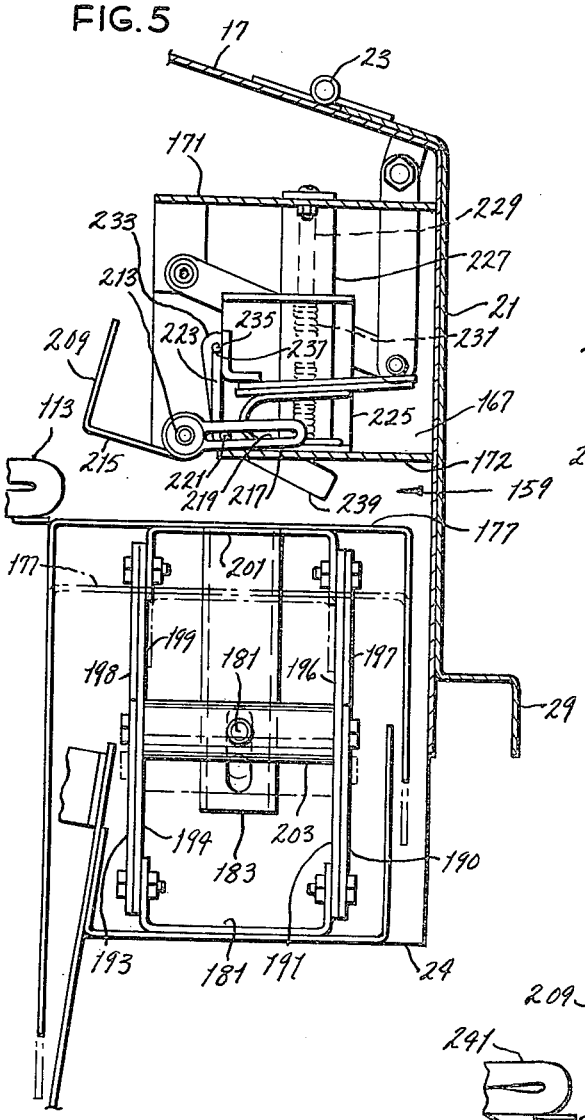
FIG. 5 is a vertical cross-section taken generally along line 5—5 of FIG. 3 showing a latch mechanism and adjustable throat carriage mechanism.

Referring to FIGS. 2, 4, and 5, each of the mechanisms 179,179' has identical elements, mechanism 179' being elements designated by the same numbers but having followed by a prime. Mechanism 179 is provided with a bracket indicated at 183 which is mounted appropriately to the structure of the cabinet 3, being for example secured to a surface 189 provided by forward extension 24 so as to be supported rigidly thereby. Extending upwardly from said bracket 181 and pivotally secured thereto at opposite ends of the bracket are pairs of links 190,191 and 193,194, respectively (see particularly FIG. 5). These links each have their opposite ends pivotally secured to further pivotally secured link members 196,197 and 198,199. The latter are in turn pivotally secured to brackets as indicated at 201,201' which depend from plates 177,177' whereby scissors linkages are realized. Extending across the sets of links at the intermediate point of their pivotal securement to one another are dowel links, as indicated at 203,205 through which threaded rod 181 passes.

On each of these dowel rods of each of these mechanisms 179,179' is threaded whereby the same will be caused to be shifted laterally in one direction or the other depending on the rotation of rod 181, which is itself prevented from being shifted by stop nuts, as indicated at 207, on opposite sides of bracket 183. Therefore, rotation of threaded rod 181 will cause brackets 201,201' to be moved up or down for lifting or lowering of carriage 175 to vary the vertical spacing of throat 159. This spacing may be adjusted to be slightly greater than the average thickness of any of the newspapers in the vendor. In this way, the throat can be dimensionally adjusted to permit only a single newspaper to be withdrawn, at any time, through the throat.

To prevent a customer from repeatedly withdrawing newspapers through the throat during a single vend cycle, latch mechanisms in housings 167,167' are operable to cause blocking plates 209,209' to swing down into a position preventing a subsequent newspaper from being withdrawn after a first one has been withdrawn through throat 159 by the customer. Such latching mechanisms, which are seen in perspective in FIG. 4, are designated in their entirety 211,211'. Since each such mechanism is merely the mirror image of the other and, therefore, identical to this extent in configuration and operation, only one is described.

Referring to FIGS. 5–9, each such mechanism comprises a shaft 213 extending transversely the width of the respective latch housings 167,167' proximate the rear of the housing and rotatably mounted therein as by extending through apertures in the side walls in the housing. Blocking plate 209 is carried by shaft 213 and, for this purpose, constitutes a flange of a further plate portion 215 which is secured to shaft 213 for pivotal movement in accordance with the position of an arm 217 extending radially from the shaft into housing 167. Such arm is positioned by operation of the latching mechanism 211, being normally in the position shown in FIG. 5 for raising the blocking plate 209.

Arm 217 is seen to be provided with a longitudinally extending slot 219 in which a pin 221 is fitted, said pin being attached to an L-shaped bracket member 223 which is in turn affixed to a U-shaped bracket member 225 unitary assembly which is apertured for sliding movement vertically on a bar 227 and a rod 229 parallel to the bar, both extending between the top 171 and bottom 172 of the latch mechanism housing. Said U-shaped bracket member 225 is biased upwardly by a coil compression spring 231 (see FIGS. 4 and 5). This assembly comprising bracket members 223 and 225 (to which pin 221 is affixed for movement therewith) is retained in a lower position shown in FIG. 5 against the force of spring 231 by a latch release arm 233 having a pin 235 at one extremity thereof seated upon a shoulder 237 of bracket member 223. The latch release arm 233 is pivotally secured as indicated at 236 to the floor 172 of the housing. Extending through an appropriate slot in floor 172 is latch release arm extension 239 which depends into throat 159 for being engaged by a newspaper pulled therethrough by a customer. Since each latch mechanism 211,211' operates identically, both blocking plates 209,209' are caused to rotate to the blocking position shown in FIGS. 4–7 upon movement of a newspaper through the throat.

Figure 6:
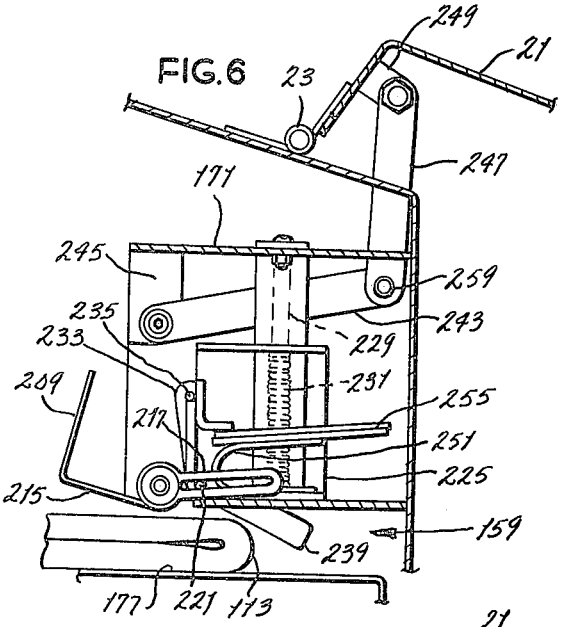
FIG. 6 is a vertical cross-section similar to FIG. 5 showing certain operation aspects of the latch mechanism.
Figure 7:
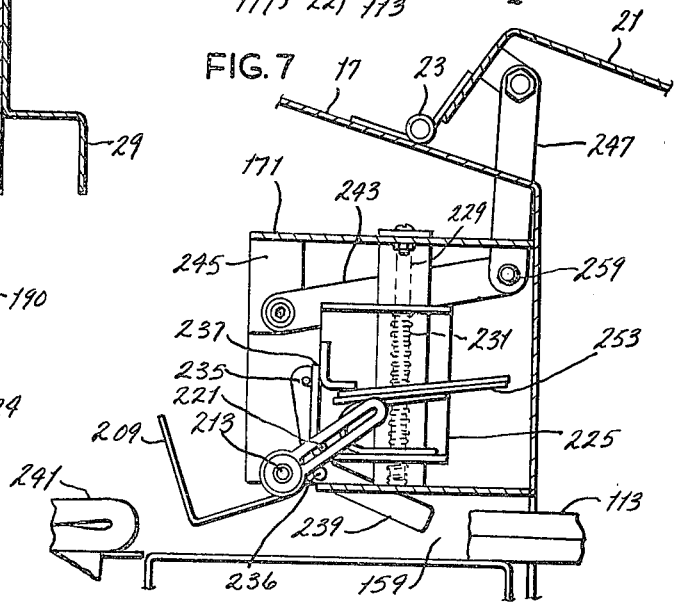
FIG. 7 is a vertical cross-section similar to FIG. 6 and illustrating actuation of the latch mechanism.
Figure 8:
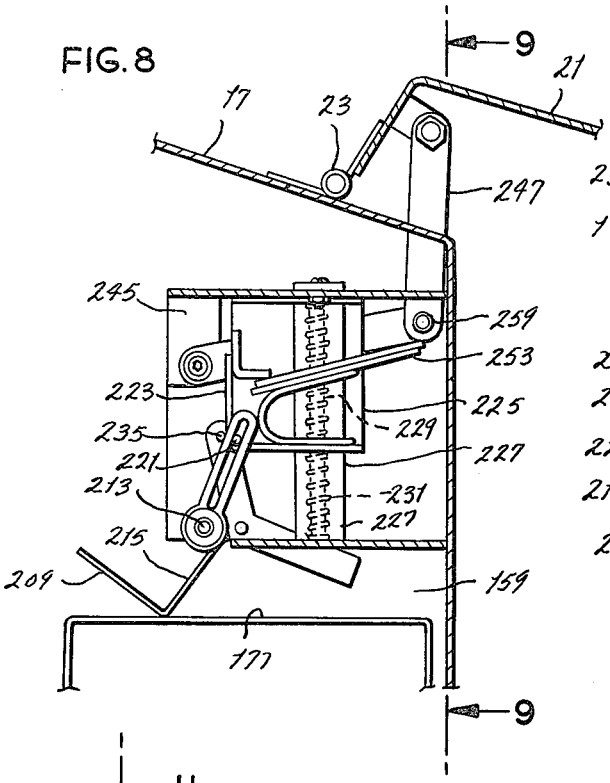
FIG. 8 is a vertical cross-section similar to FIG. 7 and showing further operation of the latch mechanism.
Figure 9:
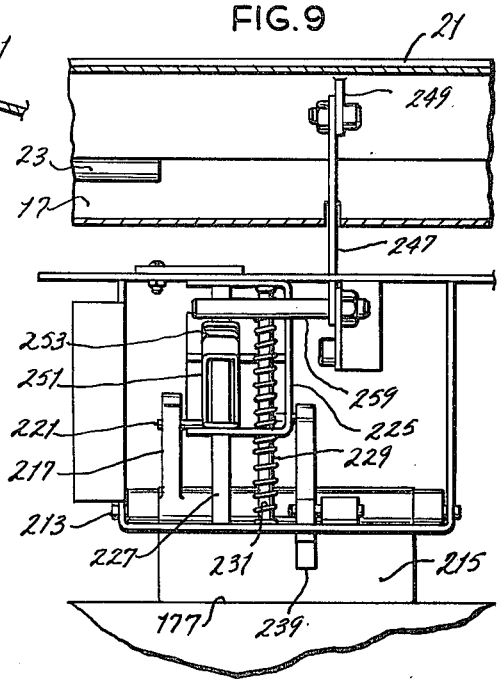
FIG. 9 is a vertical cross-section taken generally along line 9—9 of FIG. 8 to illustrate other aspects of the latch mechanism.

To illustrate, in FIG. 5 the uppermost newspaper 113 is shown approaching throat 159. The vertical spacing of the throat has been adjusted by operation of threaded rod 181 of the carriage mechanism to permit only a single newspaper to be drawn through the throat. In FIG. 6, the newspaper 113 is shown having entered throat 159, as it is being pulled forwardly by the customer who has grasped the newspaper by reaching into mouth 165, but has not yet engaged latch operating arm 239. Therefore, pin 221 of the latch mechanism maintains arm 217 of the blocking plate assembly out of contact with the newspaper. When the newspaper engages arm 239, latch arm 233 is rotated counterclockwise to move pin 235 off shoulder 237, allowing the latch bracket assembly to move upwardly in response to the pressure of spring 231, carrying pin 221 with it for corresponding counterclockwise rotation of arm 217 about pivot shaft 213 for causing plate member 215 to move downwardly against the newspaper being withdrawn. As the newspaper leaves throat 159, as depicted in FIG. 7, blocking plate 209 is permitted to continue rotating downwardly about shaft 213 to the position shown, preventing a further newspaper such as indicated at 241 from being pulled through the throat until the latch mechanisms are reset.

For resetting the latch mechanisms, it is to be observed that a linkage is provided including a first link 243 pivotally secured at one end to a bracket 245, there being a second link 247 pivotally secured to the outer end of link 243 and extending upwardly to a pivotal connection at a bracket 249 carried by cover 21. When the cover is in the position near the top 171 of the latch mechanism housing. Secured to bracket member 225 by a C-shaped leaf spring 251 is an extension 253 of rigid stock having a distal end 255 adapted to be engaged by a stud or pivot extension 259 extending laterally from the pivotal interconnection of links 243,247. When the latch assembly has been released with bracket 225 occupying the position shown in FIG. 8, extension 253 is positioned for being engaged by pivot extension 259 upon movement of cover 21 to its closed position in response to the force of gravity overcoming the tension of spring 231. That is, the cover when closing cams extension 253 downwardly for resetting the latch with the mechanism then being configured once more again as shown in FIG. 5.

In operation, it may be noted that vendor 1 is first loaded with newspaper stack 37 by an authorized person who will, for this purpose, suitably release coin mechanism 25 whereby cover 21 may be raised. Such person may then depress spring pawl release lever 107 to release the tension on cables 89,89', the top 17 of the vendor having first been opened by pivoting upwardly for providing access to the interior of the vendor. Such person may also then shift the brake pins 127,127' as shown in FIG. 12 whereby each brake arm may also be swung upwardly to render the elevator accessible for being loaded with newspapers. Having been so loaded with the stack of newspapers as indicated at 37, a suitable crank or wrench may be applied to the tool fitment 109 of the upper spring assembly which may then be rotated several turns to load the torsion spring 95 therein to proper tension for operation. When this has been done, proper tensions exist in the cables for supporting the elevator for causing the heavy stack of newspapers to be continuously lifted upwardly for vending of newspapers one at a time. It may be noted that, since the upper and lower spring housings 91,81 independently lift the rear and front, respectively, of elevator platform 35, and even and continuous lifting of the stack occurs, rather than a mechanical step-type movement. The platform occupies the position shown in phantom and designated 35' when the last newspaper copy of the stack is to be vended.

As noted previously, skewing of the stack normally results from the non-uniformity of thickness of the individual newspapers because of the side and middle folds. Such skewing from a front-to-rear aspect is shown in FIG. 2. Although platform 35 slopes forward at a considerable angle, the uppermost newspaper copy 113 is oriented such that it becomes vertically aligned with throat 159. Also, an advantage in the forward-leaning of the vendor and stack 37 is that the weight of newspapers acts to keep the front face of the stack against cables 73,73' which prevents chafing or rubbing of the individual newspapers as they move upward with them. Moreover, the forward leaning of the stack causes the newspapers to be oriented for tending to slide forward for easier vending.

Referring to FIG. 15, lateral skewing is also apparent wherein it is possible to provide for the uppermost newspaper 113 to be horizontal for engagement by the brake arm rollers 117,117', but the bottom of the stack is at a substantial angle made possible by tipping of elevator platform 35 about pivot 69. When the vendor is then closed, having been loaded, newspapers are properly presented for being vended. At this time, the vertical spacing of throat 159 may also appropriately be adjusted, if necessary, by engaging fitting 185 through aperture 187 with a suitable crank-type tool and rotating shaft 181 to cause the throat spacing to be appropriately dimensionally for permitting only one newspaper to be pulled through the throat. A large variation in spacing is permitted. FIG. 5 demonstrates that the upper surface 177, the top of carriage 175 may be located as shown in phantom at 117' whereby even the typical thick Sunday edition will be accommodated by the throat.

Coin mechanism 25 may be vertically hingedly affixed to the vendor enclosure for being swung outwardly by an authorized person to render aperture 187 (FIG. 4) accessible. But when thereafter appropriately secured, coin mechanism 25 blocks aperture 187 and cover 21 may be closed wherein the vendor is once more configured as shown in FIG. 1 in readiness for use by customers.

Upon insertion of the proper coins in slot 26, a customer may raise cover 21 and withdraw a single newspaper through throat 159. As the newspaper is withdrawn, the latch mechanisms cause blocking plates 209,209' to drop for preventing a second newspaper from being vended. Having obtained the newspaper, the customer permits cover 21 to close under its own weight. This resets the latch mechanisms and cover 21 is retained in the closed position by coin mechanism 25 in readiness for a subsequent vend cycle.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A vendor for newspapers or the like comprising means for containing a stack of newspapers, means for lifting said stack for presentation of successive newspapers of said stack at a vend position, vend control means for controlling withdrawal of a single newspaper through a vend throat during a vend cycle, means for blocking withdrawal of a subsequent newspaper through said throat during said vend cycle, means for causing automatic alignment of newspapers with said throat regardless of non-uniform thicknesses of individual newspapers of said stack, and throat adjusting means for selectively adjusting the dimensions of said throat according to the average thickness of each of said newspapers, to limit said throat dimensions for permitting a single newspaper to pass therethrough, said throat being defined by opposed upper and lower surfaces each extending substantially the width of said newspapers, said throat adjusting means being adapted to selectively alter the spacing between said surfaces, said throat lower surface being constituted by a carriage, said throat adjusting means comprising a height adjusting linkage for selectively positioning said carriage with respect to said upper surface, said adjusting linkage comprising at least one jack screw, a follower threaded on said jack screw for being shifted by rotation of said jack screw, jack links interconnected with said follower and said carriage for altering the height of said carriage upon shifting of said follower, and means for permitting selective rotation of said jack screw.

2. A newspaper vendor according to claim 1, said means for containing a stack of newspapers comprising an enclosure for said vendor, said vend control means comprising a door of said enclosure for blocking access to said throat, said door being releasable by a coin mechanism for being opened during a vend cycle.

3. A vendor for newspapers or the like comprising means for containing a stack of newspapers, means for lifting said stack for presentation of successive newspapers of said stack at a vend position, vend control means for controlling withdrawal of a single newspaper through a vend throat during a vend cycle, means for blocking withdrawal of a subsequent newspaper through said throat during said vend cycle, means for causing automatic alignment of newspapers with said throat regardless of non-uniform thicknesses of individual newspapers of said stack, said means for containing a stack of newspapers comprising an enclosure for said vendor, said means for lifting of said stack comprising an elevator within said enclosure, said means for causing automatic alignment of newspapers with said throat comprising means for permitting skewing of said stack of newspapers on said elevator, said elevator comprising a platform, said means for causing automatic alignment of newspapers with said throat comprising a pivoted support for said platform, said elevator including means for resiliently biasing said support upwardly, said pivoted support permitting lateral tipping of said platform in response to skewing of said stack, whereby an uppermost newspaper of said stack is aligned with said throat, said means for biasing said support upwardly comprising at least one coiled torsion spring, at least one tensile winding element secured to said support, and rotatable cable winding means rotatably driven by said spring for tensioning and winding said cable in response to said spring for continuously lifting of said support as newspapers are successively withdrawn from said vendor during successive vend cycles, and means for halting upward movement of said elevator to cause the uppermost newspaper of said stack to be presented proximate said vend throat, wherein said means for halting upward movement comprises brake means including at least one arm adapted to be contacted by said uppermost newspaper, means pivotally mounting said arm for pivotal movement in response to being contacted by said uppermost newspaper, and means operatively engaging said winding means for braking rotation thereof to halt upward movement of said elevator when said uppermost newspaper is proximate said vend throat.

4. A newspaper vendor according to claim 3, said means for biasing said support upwardly comprising a further coiled torsion spring, the first said tensile windable element being secured to said support at the rear of said platform, a plurality of further tensile windable elements secured to said support at the front of said platform, and a further rotatable winding means rotatably driven by said further coiled torsion spring for tensioning and winding of said further tensile windable elements for continuously lifting of the first of said support as newspapers are successively withdrawn from said vendor during successive vend cycles.

5. A newspaper vendor according to claim 4, said elevator platform being inclined for causing forward tilting of said stack toward the front of said vendor, said vend throat being at the front of said vendor, said further tensile windable elements supporting the front of said stack without movement relative to newspapers of said stack.

* * * * *